US007489080B2

(12) United States Patent
Kim et al.

(10) Patent No.: US 7,489,080 B2
(45) Date of Patent: Feb. 10, 2009

(54) DIRECT CURRENT PLASMA PANEL (DC-PDP) AND METHOD OF MANUFACTURING THE SAME

(75) Inventors: Gi-Young Kim, Suwon-si (KR); Hyoung-Bin Park, Suwon-si (KR); Sang-Hun Jang, Suwon-si (KR); Seung-Hyun Son, Suwon-si (KR); Sung-Soo Kim, Suwon-si (KR); Ho-Nyeon Lee, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 9 days.

(21) Appl. No.: 11/511,235

(22) Filed: Aug. 29, 2006

(65) Prior Publication Data

US 2007/0046206 A1 Mar. 1, 2007

(30) Foreign Application Priority Data

Aug. 29, 2005 (KR) ..... 10-2005-0079228

(51) Int. Cl.

*H05B 37/00* (2006.01)
*H01J 17/49* (2006.01)
*H05B 33/08* (2006.01)

(52) U.S. Cl. ..... 313/587; 313/581; 313/582; 313/583; 313/584; 313/585; 315/169.3; 445/24

(58) Field of Classification Search ..... 313/580–587; 315/169.1, 169.3

See application file for complete search history.

(56) References Cited

U.S. PATENT DOCUMENTS

| | | | | |
|---|---|---|---|---|
| 5,973,449 | A * | 10/1999 | Nakamura et al. | 313/461 |
| 6,940,087 | B2 * | 9/2005 | Komoda et al. | 257/10 |
| 2006/0012304 | A1 * | 1/2006 | Son et al. | 313/586 |
| 2006/0055314 | A1 * | 3/2006 | Nakamura et al. | 313/500 |

* cited by examiner

*Primary Examiner*—Sikha Roy
*Assistant Examiner*—Tracie Y Green
(74) *Attorney, Agent, or Firm*—Lee & Morse, P.C.

(57) ABSTRACT

A direct current plasma display panel (DC-PDP) includes a first substrate and a second substrate facing each other, discharge cells between the first substrate and the second substrate, first and second electrodes disposed in each of the discharge cells, first conductive silicon layers contacting the first electrodes, first oxidized porous silicon layers contacting the first conductive silicon layers, second conductive silicon layers contacting the second electrodes, second oxidized porous silicon layers contacting the second conductive silicon layers, phosphor layers arranged in the discharge cells, and a discharge gas disposed in the discharge cells.

21 Claims, 4 Drawing Sheets

DIRECT CURRENT PLASMA PANEL (DC-PDP) AND METHOD OF MANUFACTURING THE SAME

BACKGROUND OF THE INVENTION

1. Field of the Invention

The present invention relates to a direct current type plasma display panel (DC-PDP). More particularly, the present invention relates to a DC-PDP having a simple structure, thereby being easily manufactured and reducing manufacturing costs, and a method of manufacturing the DC-PDP.

2. Description of the Related Art

Plasma display panels (PDPs) have recently replaced conventional cathode ray tubes (CRTs) as display devices. In a PDP, a discharge gas is sealed between two substrates, a plurality of discharge electrodes are provided between the two substrates, a discharge voltage is applied thereto, phosphor between the two substrates in a predetermined pattern is excited by ultraviolet (UV) light generated by the discharge gas in response to the discharge voltage, thereby displaying a desired image. PDPs are classified into direct current (DC) panels and alternating current (AC) panels according to discharge types.

The DC panels include discharge electrodes exposed to a discharge space. During operation of DC panels, a direct discharge occurs between the discharge electrodes, resulting in a discharge current. It is important to properly control the discharge current to operate the DC panels.

Therefore, conventional DC panels include resistances for limiting current to control the discharge current in each of a plurality of discharge cells forming discharge spaces. Thus, conventional DC panels require additional costs for manufacturing and arranging the resistances, and involve a high failure rate due to complex processes for manufacturing and arranging the resistances.

SUMMARY OF THE INVENTION

The present invention is therefore directed to a direct current plasma display panel (DC-PDP), which substantially overcomes one or more of the problems due to the limitations and disadvantages of the related art It is therefore a feature of an embodiment of the present invention to provide a DC-PDP that controls a discharge current using at least one of conductive silicon layers and oxidized porous silicon layers.

It is another feature of an embodiment of the present invention to provide a DC-PDP having a multi-layer structure through which visible light is transmitted to increase bright room contrast.

It is yet another feature of an embodiment of the present invention to provide a DC-PDP having a reduced operating voltage.

At least one of the above and other features and advantages of the present invention may be realized by providing a direct current plasma display panel (DC-PDP), including a first substrate and a second substrate facing each other, discharge cells between the first substrate and the second substrate, first and second electrodes disposed in each of the discharge cells, first conductive silicon layers contacting the first electrodes, first oxidized porous silicon layers contacting the first conductive silicon layers, second conductive silicon layers contacting the second electrodes, second oxidized porous silicon layers contacting the second conductive silicon layers, phosphor layers arranged in the discharge cells, and a discharge gas disposed in the discharge cells.

One of the first electrode and the second electrode may be a cathode electrode, and another may be an anode electrode.

The first electrodes may extend in a first direction and the second electrodes may extend in a second direction crossing the first direction.

The first and/or second conductive silicon layers may be doped polysilicon layers, and the first and/or second oxidized porous silicon layers may be oxidized porous polysilicon layers. The first and/or second conductive silicon layers may be doped amorphous polysilicon layers, and the first and/or second oxidized porous silicon layers may be oxidized porous amorphous silicon layers. The first and second conductive silicon layers may be a same material.

The first electrodes may be arranged on a surface of the first substrate and the second electrodes are arranged on a surface of the second substrate, the second electrodes facing the first electrodes.

The first electrodes and second electrodes may be arranged on a surface of the second substrate.

The first and second conductive silicon layers may respectively directly contact only an upper surface of the first and second electrodes. The first and second conductive silicon layers may respectively directly contact an upper surface of the first and second electrodes and at least one side surface of the first and second electrodes.

Relative thicknesses of the first and second conductive silicon layers, and the first and second oxidized porous silicon layers may be selected in accordance with a desired DC-PDP performance.

At least one of the above and other features and advantages of the present invention may separately be realized by providing a method of manufacturing a DC-PDP including forming electrodes on a surface of a substrate, forming a silicon layer to cover the electrodes, forming a conductive silicon layer by doping at least part of the silicon layer, forming a porous silicon layer by changing at least part of the silicon layer, and changing the porous silicon layer to an oxidized porous silicon layer.

The silicon layer may be polysilicon or amorphous silicon.

The silicon layer may be formed using a plasma-enhanced chemical vapor deposition (PECVD) process.

The porous silicon layer may be formed by anodizing at least part of the silicon layer using a solution including hydrogen fluoride (HF) and ethanol.

The oxidized porous silicon layer may be formed by electrochemically oxidizing the porous silicon layer.

The silicon layer may be formed directly on the electrodes.

Forming the electrodes may include forming first electrodes on a first substrate and second electrodes on a second substrate, the first and second electrodes facing each other.

Forming the electrodes may include forming first electrodes and second electrodes on a surface of a same substrate.

Relative thicknesses of the conductive silicon layers and the oxidized porous silicon layer are selected in accordance with a desired DC-PDP performance.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF THE INVENTION

Figure 1:
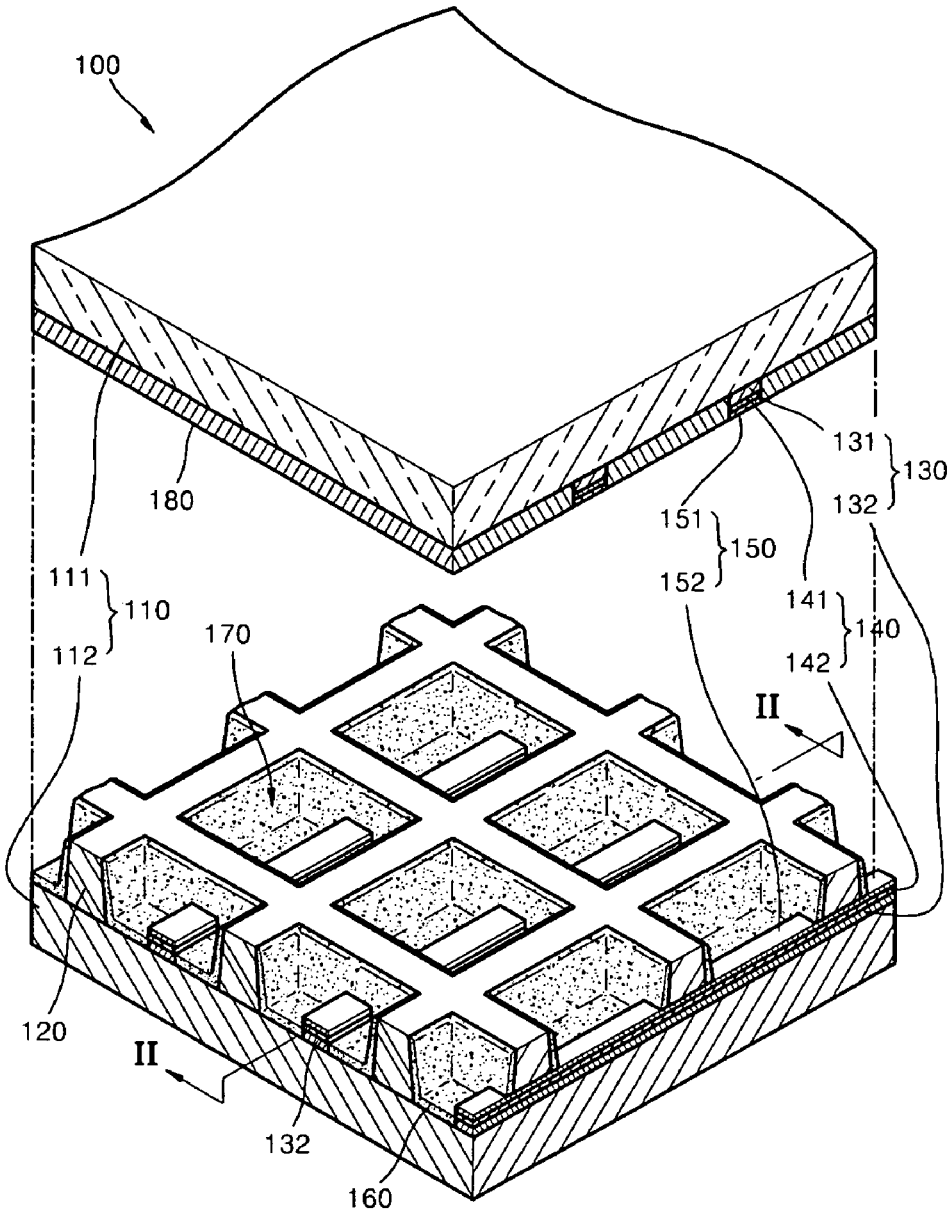
FIG. 1 illustrates a partially exploded perspective view of a direct current plasma display panel (DC-PDP) according to an embodiment of the present invention.

Korean Patent Application No. 10-2005-0079228, filed on Aug. 29, 2005, in the Korean Intellectual Property Office, and entitled: "Direct Current Type Plasma Display Panel (PDP) and Method of Manufacturing the Same," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

In the figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. It will also be understood that the term "phosphor" is intended to generally refer to a material that can generate visible light upon excitation by ultraviolet light that impinges thereon, and is not intended be limited to materials that undergo light emission through any particular mechanism or over any particular time frame. Like reference numerals refer to like elements throughout.

A direct current plasma display panel (DC-PDP) in accordance with embodiments of the present invention provides a sequential stack of a low resistance layer and a high resistance layer, e.g., a conductive silicon layer and oxidized porous silicon layer, on electrodes of the DC-PDP. A relative thickness of these layers may be selected to control discharge current, decrease operating voltage and/or increase bright room contrast.

Figure 2:
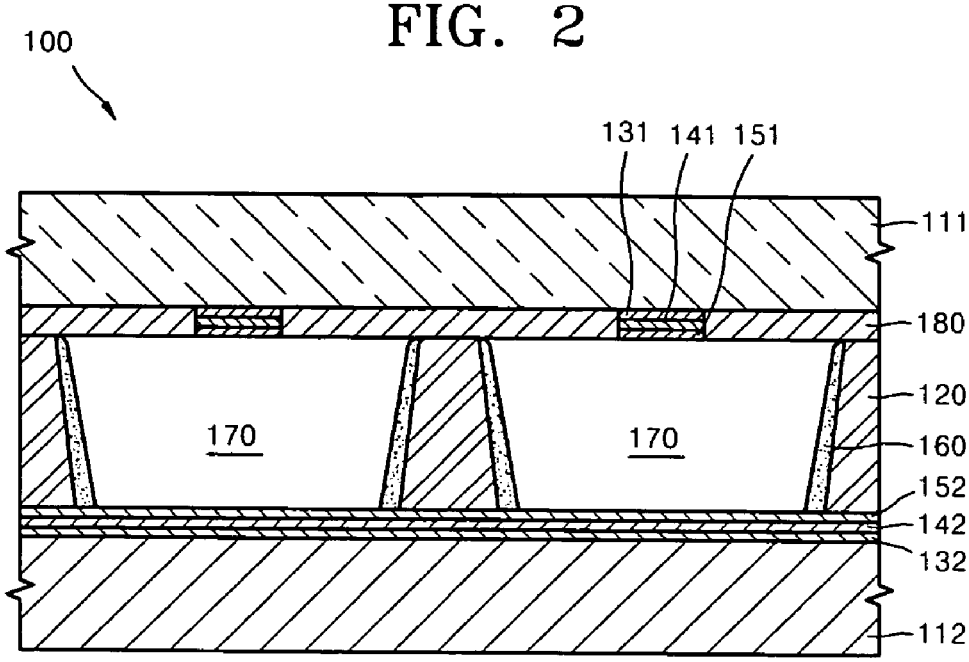
FIG. 2 illustrates a cross-sectional view of the DC-PDP of FIG. 1 taken along a line II-II in FIG. 1.

FIG. 1 illustrates a partially exploded perspective view of a DC-PDP 100 according to an embodiment of the present invention. FIG. 2 illustrates a cross-sectional view of the DC-PDP of FIG. 1 taken along a line II-II in FIG. 1.

Referring to FIGS. 1 and 2, the DC-PDP 100 may include a pair of substrates 110, barrier ribs 120, electrodes 130, conductive silicon layers 140, oxidized porous silicon layers 150, and phosphor layers 160.

The pair of substrates 110 may include a first substrate 111 and a second substrate 112 facing each other and spaced apart from each other by a predetermined gap. The first substrate 111 may be transparent, e.g., made of glass, allowing visible light to be transmitted.

In the current exemplary embodiment of the present invention, the first substrate 111 may be transparent, so that visible light generated by a discharge transmits through the first substrate 111, but the present invention is not restricted thereto. Alternatively, the first substrate 111 may be formed of an opaque material, and the second substrate 112 may be formed of a transparent material, or both the first and second substrates 111 and 112 may be formed of a transparent material. Also, alternatively, the first and second substrates 111 and 112 may both be formed of a translucent material and may include a color filter.

The barrier ribs 120 may be formed of a dielectric substance, may be interposed between the first and second substrates 111 and 112, and may, along with the first and second substrates 111 and 112, partition discharge cells 170. In the current exemplary embodiment of the present invention, the discharge cells 170 partitioned by the barrier ribs 120 have rectangular cross-sections. However, the shape of the discharge cells 170 is not limited to this. The barrier ribs 130 may form a variety of patterns, e.g., open-type barrier ribs such as stripes, and closed-type barrier ribs such as waffle, matrix, or delta. If closed-type barrier ribs are used, the cross-sections of the discharge cells 170 may have circular shapes, elliptical shapes or polygonal shapes, e.g., triangular or pentagonal shapes, as well as rectangular shapes.

The electrodes 130 may include first electrodes 131 and second electrodes 132. The first electrodes 131 may be disposed on a surface of the first substrate 111. The second electrodes 132 may be disposed on a surface of the second substrate 112.

The first electrodes 131 may serve as anode electrodes, may be stripe-shaped, and may cross the discharge cells 170. The first electrodes 131 may be formed of a transparent material such as indium tin oxide (ITO).

The second electrodes 132 may serve as cathode electrodes, may be stripe-shaped, and may cross the discharge cells 170. The second electrodes 132 may be formed of an opaque, conductive material, e.g., a metal, such as copper (Cu).

In the current exemplary embodiment of the present invention, the first electrodes 131 serve as the anode electrode, and the second electrodes 132 serve as the cathode electrode emitting electrons, but the present invention is not limited thereto. In detail, alternatively, the first electrodes 131 may serve as the cathode electrodes, and the second electrodes 132 may serve as the anode electrodes. Further, in the current exemplary embodiment of the present invention, the second electrodes 132 are opaque, but the present invention is not limited thereto. For example, the second electrodes 132 may also be transparent.

Conductive silicon layers 140 may be doped with silicon and formed on a surface of the electrodes 130. The silicon may be polysilicon or amorphous silicon.

The conductive layers 140 may include a first conductive silicon layer 141 and a second conductive silicon layer 142. The first conductive silicon layer 141 may directly contact a bottom surface of the first electrodes 131, and the second conductive silicon layer 142 may directly contact an upper surface of the second electrodes 132.

In the current exemplary embodiment of the present invention, the first conductive silicon layer 141 may be directly on the bottom surface of the first electrodes 131, and the second conductive silicon layer 142 may be directly on the upper surface of the second electrodes 132, but the present invention is not limited thereto. In detail, the first conductive silicon layer 141 may bury the first electrodes 131. In this case, the first conductive silicon layer 141 may be formed in the first substrate 111 around the first electrodes 131, as well as on the bottom surface of the first electrodes 131. Likewise, the second conductive silicon layer 142 may bury the second electrodes 132. In this case, the second conductive silicon layer 142 may be formed in the second substrate 112 around the second electrodes 132, as well as on the upper surface of the second electrodes 132.

Oxidized porous silicon layers 150 may include a first oxidized porous silicon layer 151 and a second oxidized porous silicon layer 152. The first oxidized porous silicon layer 151 may directly contact a bottom surface of the first conductive silicon layer 141, and the second oxidized porous silicon layer 152 may directly contact an upper surface of the second conductive silicon layer 142.

In the current exemplary embodiment of the present invention, the first oxidized porous silicon layer 151 may contact only the bottom surface of the first conductive silicon layer 141, and the second oxidized porous silicon layer 152 may contact only the upper surface of the second conductive silicon layer 142, but the present invention is not limited thereto. In detail, the first oxidized porous silicon layer 151 may bury the first electrodes 131 and the first conductive silicon layer 141. In this case, the first oxidized porous silicon layer 151 may be formed in the first substrate 111 around the first electrodes 131, as well as on the bottom surface of the first conductive silicon layer 141. Likewise, the second oxidized porous silicon layer 152 may bury the second electrodes 132 and the second conductive silicon layer 142. In this case, the second oxidized porous silicon layer 152 may be formed in the second substrate 112 around the second electrodes 132, as well as on the upper surface of the second conductive silicon layer 142.

A dielectric layer 180 may be formed on a portion of the bottom surface of the first substrate 111 in which the first electrodes 131, the first conductive silicon layer 141, and the first oxidized porous silicon layer 151 are not formed.

The phosphor layers 160 may be formed on sidewalls of the barrier ribs 120 and on a portion of the upper surface of the second substrate 112 forming the bottom surface of the discharge cells 170 in which the second electrodes 132 are not formed. Material of the phosphors layers 160 may be selected in accordance with a color of respective discharge cells, e.g., red, green, and blue discharge cells 170.

The phosphor layers 160 may include a component generating visible light in response to ultraviolet (UV) light. For example, a phosphor layer in a red light emitting discharge cell may include a phosphor such as $Y(V,P)O_4$:Eu, a phosphor layer in a green light emitting discharge cell may include a phosphor such as $Zn_2SiO_4$:Mn, $YBO_3$:Tb, and a phosphor layer in a blue light emitting discharge cell may include a phosphor such as BAM:Eu.

In the current exemplary embodiment of the present invention, the phosphor layers 160 may be formed on the sidewalls of the barrier ribs 120 and the portion of the upper surface of the second substrate 112 forming the bottom surface of the discharge cells 170 in which the second electrodes 132 are not formed, but the present invention is not limited thereto. In detail, the phosphor layers 160 may be formed in any portion of the discharge cells 170, e.g., the bottom surface of the first substrate 111, in order to emit visible light in response to UV light generated by a plasma discharge.

After the first substrate 111 and the second substrate 112 are sealed, e.g., with a frit, etc., a discharge gas, e.g., Ne, Xe, or a mixture thereof, may fill the DC-PDP 100.

A method of manufacturing the DC-PDP 100 will now be described, with reference to FIGS. 3 through 7. FIGS. 3 through 7 illustrate cross-sectional views of stages in a method of manufacturing a first substrate 111 of the DC-PDP of FIG. 1.

Figure 3:
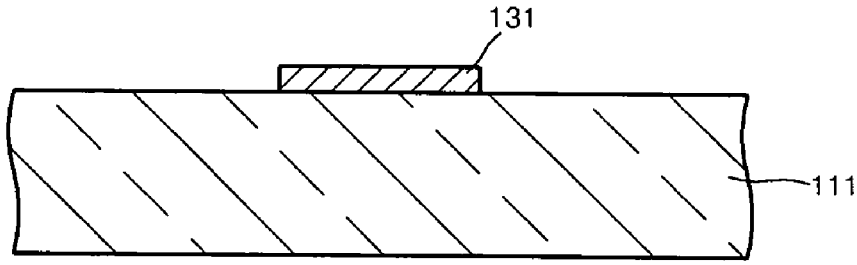
FIGS. 3 through 7 illustrate cross-sectional views in stages of a method of manufacturing a first substrate of the DC-PDP of FIG. 1.

Referring to FIG. 3, the first electrodes 131 may be formed on the first substrate 111, e.g., using a printing process, etc.

Figure 4:
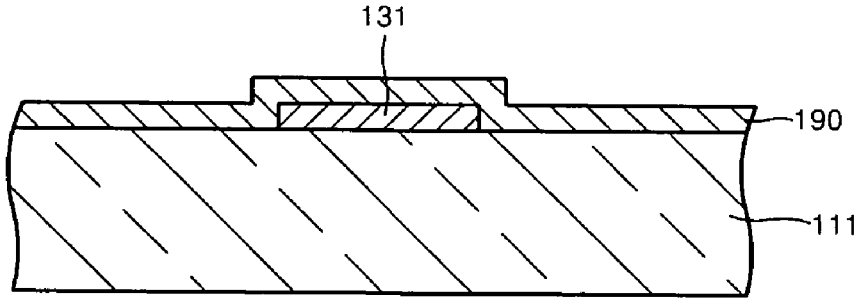

Referring to FIG. 4, the first electrodes 131 may be buried by a silicon layer 190. As noted above, the silicon layer 190 may be formed of polysilicon or amorphous silicon. The silicon layer 190 may be formed, e.g., using plasma-enhanced chemical vapor deposition (PECVD) at a temperature below about 400° C.

Figure 5:
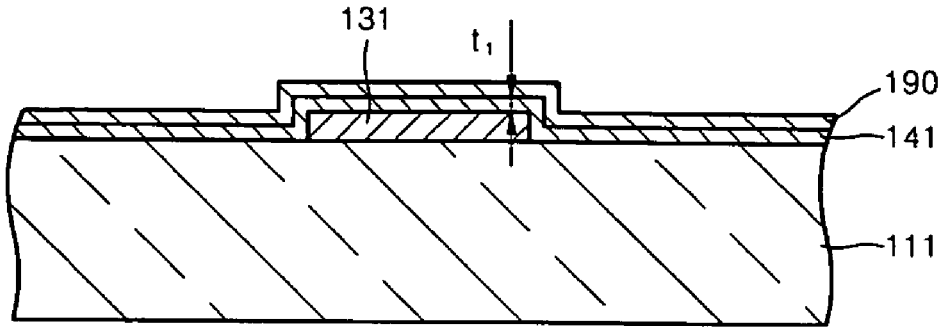

Referring to FIG. 5, the first conductive silicon layer 141 having a predetermined thickness $t_1$ may be formed in the lower portion of the silicon layer 190. In detail, a heavy doping process may be performed in the silicon layer 190, e.g., using an implanter deposition while an accelerating energy of incidence ions is controlled to concentrate a dopant in a portion of the silicon layer 190 contacting the first substrate 111 and the first electrodes 131, thereby converting a lower portion of the silicon layer 190 into the first conductive silicon layer 141.

Figure 6:
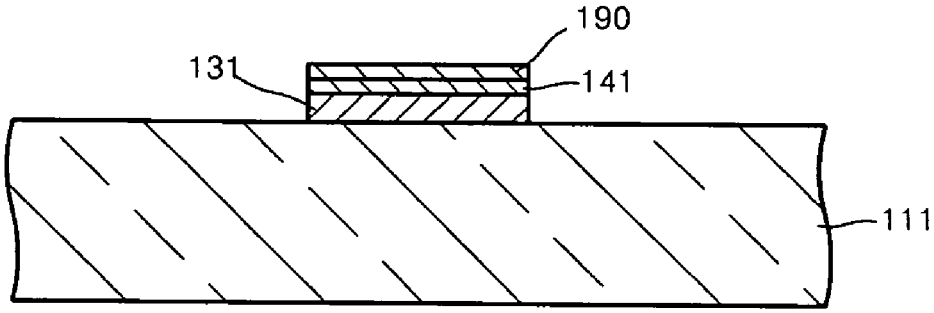

Referring to FIG. 6, portions of the first conductive silicon layer 141 and the silicon layer 190 other than those on the first electrodes 131 may be removed from the first substrate 111.

In the current exemplary embodiment of the present invention, portions of the first conductive silicon layer 141 and the silicon layer 190 other than those on the first electrodes 131 are removed from the first substrate 111, but the present invention is not limited thereto. In detail, the first conductive silicon layer 141 and the silicon layer 190 may bury the first electrodes 131, or the first conductive silicon layer 141 and the silicon layer 190 illustrated in FIG. 5 may remain unchanged.

The silicon layer 190 may be anodized, e.g., by applying an appropriate proper current density to the first electrodes 131 and using a solution including hydrogen fluoride (HF) and ethanol, thereby changing the silicon layer 190 into a porous layer. The anodized silicon layer 190 may be electrochemically oxidized and may be changed to the first oxidized porous silicon layer 151 having a predetermined thickness $t_2$.

Figure 7:
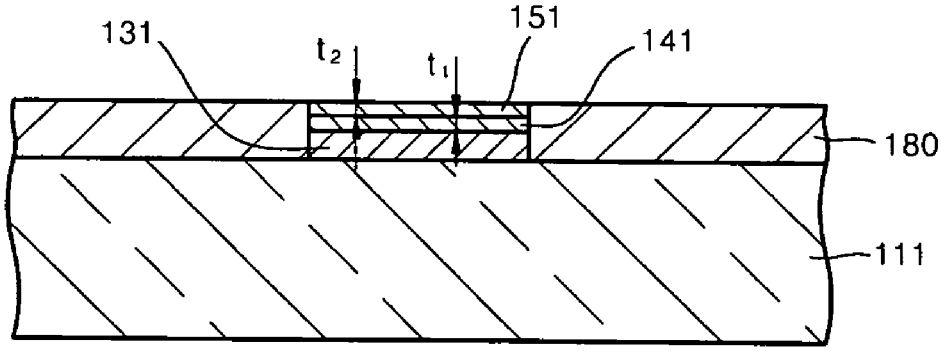

Referring to FIG. 7, the dielectric layer 180 having an appropriate thickness may be formed on a portion of the first substrate 111 where the first electrodes 131, the first conductive silicon layer 141, and the first oxidized porous silicon layer 151 are not formed.

The second electrodes 132 may be formed on the second substrate 112, e.g., using a printing process. The second conductive silicon layer 142 and the second oxidized porous silicon layer 152 may be formed on the second electrodes 132 using the same method of manufacturing the first conductive silicon layer 141 and the first oxidized porous silicon layer 151.

The barrier ribs 120 may be formed on the second substrate 112, e.g., using a printing process, etc. The phosphor layers 160 may be disposed on a portion of the second substrate 112, which forms a bottom surface of the discharge cells 170, where the second electrodes 132 are not disposed, and on sidewalls of the barrier ribs 120. The first substrate 111 and the second substrate 112 may then be secured and sealed, and the discharge gas may fill the DC-PDP 100.

The operation of the DC-PDP 100 will now be described. An addressing operation for selecting a discharge cell from the discharge cells 170 in which a discharge is performed to operate the DC-PDP 100 may use a conventional addressing method, e.g., a simple scan method, a self-scan™ method, a pulse memory drive method, etc.

When a discharge voltage is applied between the first electrodes 131 and the second electrodes 132 from an external power source, electrons are emitted from the second electrodes 132 serving as the cathode electrodes to the discharge cells 170 through the second conductive silicon layer 142 and the second oxidized porous silicon layer 152. Discharge is performed using the electrons emitted to the discharge cells 170. The first electrodes 131 serving as the anode electrodes absorb the electrons through the first conductive silicon layer 141 and the first oxidized porous silicon layer 151.

During this process, discharge is directly performed between the first electrodes 131 and the second electrodes 132, resulting in a discharge current. To control the discharge operation, proper control of the discharge current is required. In the current exemplary embodiment of the present invention, the first conductive silicon layer 141, the second conductive silicon layer 142, the first oxidized porous silicon layer 151, and the second oxidized porous silicon layer 152 may be used to control the discharge current.

In detail, the first conductive silicon layer 141 and the second conductive silicon layer 142 may have a low electrical resistance due to the doping, whereas the first oxidized porous silicon layer 151 and the second oxidized porous silicon layer 152 may have a high electrical resistance. Therefore, a designer may determine a resistance necessary for controlling the discharge current, may select a proper thickness ratio of the conductive silicon layer 140 and the oxidized porous silicon layer 150, and may control the doping process according to the selected thickness ratio, thereby obtaining a desired resistance necessary for controlling the discharge current.

When plasma discharge is properly performed between the first electrodes 131 and the second electrodes 132, discharge gas is excited. When an energy potential of the excited discharge gas drops, UV light is emitted. The emitted UV light excites the phosphor layers 160. When an energy potential of the excited phosphor layers 160 drops, visible light is emitted. The emitted visible light is projected onto the first substrate 111 to display an image.

The DC-PDP 100 according to the current exemplary embodiment of the present invention includes the conductive silicon layer 140 and the oxidized porous silicon layer 150 to control the discharge current. Therefore, the DC-PDP 100 does not necessarily need to include resistances for controlling the discharge current, thereby reducing manufacturing time and costs.

In the current exemplary embodiment of the present invention, since the DC-PDP 100 has a multilayer structure in which the first conductive silicon layer 141 and the first oxidized porous silicon layer 151 are sequentially formed on the bottom surface of the first electrodes 131, visible light transmitted through the multilayer structure towards the first substrate 111 may interfere. Therefore, if necessary, the ratio between the thickness $t_1$ of the first conductive silicon layer 141 and the thickness $t_2$ of the first oxidized porous silicon layer 151 may be properly controlled, thereby using the interference to increase bright room contrast.

In the current exemplary embodiment of the present invention, since the electrons emitted from the second electrodes 132 are accelerated through the second oxidized porous silicon layer 152, discharge may be easily performed and an operating voltage may be reduced, thereby increasing discharge efficiency.

Figure 8:
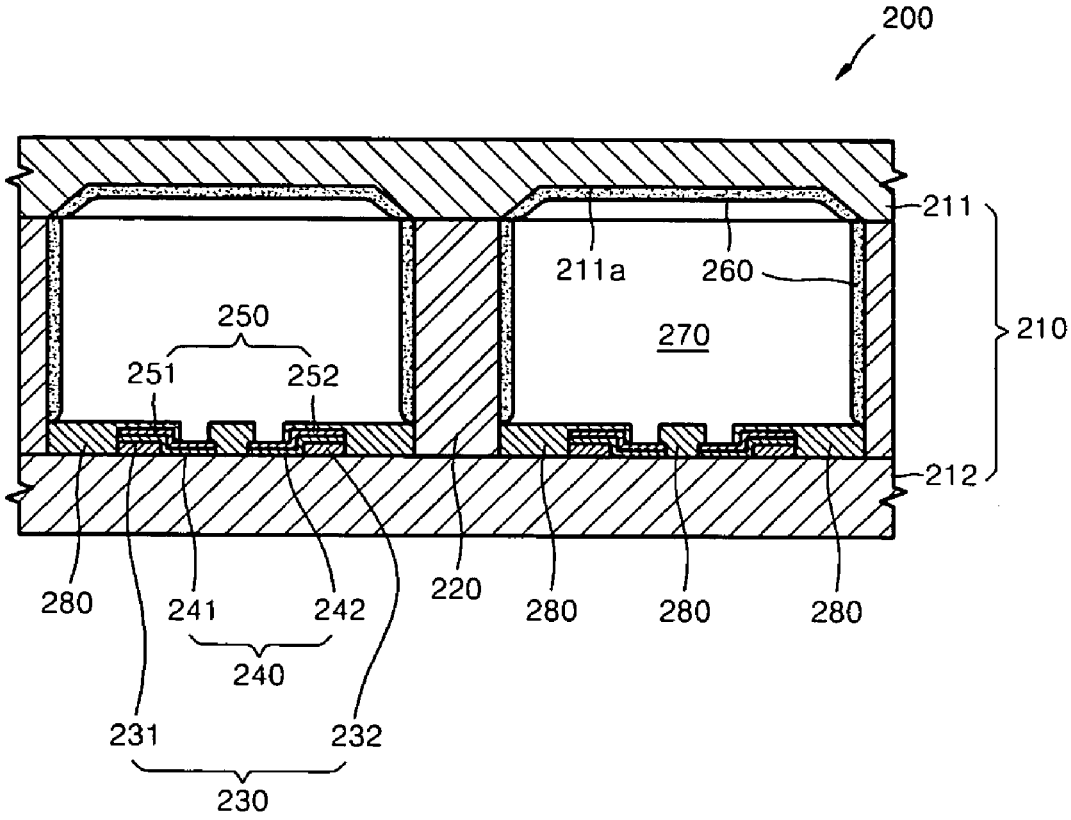
FIG. 8 illustrates a cross-sectional view of a DC-PDP according to another embodiment of the present invention.

FIG. 8 illustrates a cross-sectional view of a DC-PDP 200 according to another embodiment of the present invention. Referring to FIG. 8, the DC-PDP 200 may include a pair of substrates 210, barrier ribs 220, electrode pairs 230, conductive silicon layers 240, oxidized porous silicon layers 250, and phosphor layers 260.

The pair of substrates 210 may include a first substrate 211 and a second substrate 212, which are spaced apart from each other by a predetermined gap. The first substrate 211 may be transparent, e.g., made of glass, to transmit visible light.

The barrier ribs 220 may be formed of a dielectric substance, may be interposed between the first and second substrates 211 and 212, and may, along with the first and second substrates 211 and 212, partition discharge cells 270.

Each of the electrode pairs 230 may include a first electrode 231 and a second electrode 232. The first electrodes 231 and the second electrodes 232 may be disposed on a surface of the second substrate 212. The first electrodes 231 and the second electrodes 232 may be disposed in each of the discharge cells 270.

The first electrodes 231 may serve as anode electrodes. The second electrodes 232 may serve as cathode electrodes. The first electrodes 231 and the second electrodes 232 may be formed of a conductive material, e.g., copper (Cu).

In the current exemplary embodiment of the present invention, the first electrodes 231 serve as the anode electrodes, and the second electrodes 232 serve as the cathode electrodes emitting electrons, but the present invention is not limited thereto. In detail, alternatively, the first electrodes 231 may serve as the cathode electrodes, and the second electrodes 232 may serve as the anode electrodes.

The conductive silicon layers 240 may be doped with silicon on a surface of the electrode pairs 230 and may have conductive properties. The silicon may be polysilicon or amorphous silicon. The conductive silicon layers 240 may include a first conductive silicon layer 241 and a second conductive silicon layer 242.

The first conductive silicon layer 241 may directly contact a portion of an upper surface of the second substrate 212 and an upper surface of the first electrodes 231. The second conductive silicon layer 242 may directly contact a portion of the upper surface of the second substrate 212 and an upper surface of the second electrodes 232.

The oxidized porous silicon layers 250 may include a first oxidized porous silicon layer 251 and a second oxidized porous silicon layer 252. The first oxidized porous silicon layer 251 may directly contact an upper surface of the first conductive silicon layer 241. The second oxidized porous silicon layer 252 may directly contact an upper surface of the second conductive silicon layer 242.

A dielectric layer 280 may be formed on the upper surface of the second substrate 212, and may cover the upper surface of the second substrate 212 forming the bottom surface of the discharge cells 270, the first electrodes 231, the second electrodes 232, the first conductive silicon layer 241, the second conductive silicon layer 242, a portion of the first oxidized porous silicon layer 251, and a portion of the second oxidized porous silicon layer 252.

The phosphor layers 260 may be formed on sidewalls of the barrier ribs 220 and in grooves 211*a* of the first substrate 211 in accordance with the red, green, and blue discharge cells 170.

The phosphor layers 260 may have a component generating visible light in response to UV light. The constitution of the phosphor layers 260 forming the red, green, and blue discharge is the same as the phosphor layers 160 discussed above. Thus, detailed descriptions thereof are omitted.

After the first substrate 211 and the second substrate 212 are sealed, e.g., with a frit, etc., a discharge gas, e.g., Ne, Xe, or a mixture thereof, fills the DC-PDP 200.

The manufacturing process and operation of the DC-PDP 200 will now be described.

The grooves 211*a* may be formed, e.g., using sand blasting, etching, etc. on the first substrate 211.

The first electrodes 231 and the second electrodes 232 may be formed on the upper surface of the second substrate 212, e.g., using a printing process, etc., a silicon layer may be formed and a doping process may be performed to form the first conductive silicon layer 241 and the second conductive silicon layer 242 having electrical conductivity using the same method as described in the previous embodiment of the present invention.

The first oxidized porous silicon layer 251 and the portion of the second oxidized porous silicon layer 252 may be formed using the anodization and electrochemical oxidization as described in the previous embodiment of the present invention.

The barrier ribs 220 and the dielectric layer 280 may be formed on the second substrate 212. The phosphor layers 260 may be formed on sidewalls of the barrier ribs 220 and the grooves 211*a* of the first substrate 211.

After the first substrate 211 and the second substrate 212 are sealed, the discharge gas may fill the DC-PDP 200.

The operation of the DC-PDP 200 will now be described.

Since, in the DC-PDP 200, each of the discharge cells 270 includes a pair of the first electrode 231 and the second electrode 232, a direct addressing method may be used to select a discharge cell 270 in which a discharge is performed.

When a discharge voltage is applied between the first electrodes 231 and the second electrodes 232 from an external power source, electrons are emitted from the second electrodes 232 serving as the cathode electrodes to the discharge cells 270 through the second conductive silicon layer 242 and the second oxidized porous silicon layer 252.

The discharge is performed using the electrons emitted to the discharge cells 270. The first electrodes 231 serving as the anode electrodes absorb the electrons through the first conductive silicon layer 241 and the first oxidized porous silicon layer 251.

During this process, discharge is directly performed between the first electrodes 231 and the second electrodes 232, resulting in a discharge current. The first conductive silicon layer 241 and the second conductive silicon layer 242 have a low electrical resistance due to the doping, whereas the first oxidized porous silicon layer 251 and the second oxidized porous silicon layer 252 have a high electrical resistance. Therefore, a designer may determine a resistance necessary for controlling the discharge current, may select a proper thickness ratio of the conductive silicon layer 240 and the oxidized porous silicon layer 250, and may control the doping process according to the selected thickness ratio, thereby obtaining a desired resistance necessary for controlling the discharge current.

When plasma discharge is properly performed between the first electrodes 231 and the second electrodes 232, discharge gas is excited. When an energy potential of the excited discharge gas drops, UV light is emitted. The emitted UV light excites the phosphor layers 260. When an energy potential of the excited phosphor layers 260 drops, visible light is emitted. The emitted visible light is projected onto the first substrate 211 to display an image.

The DC-PDP 200 according to the current embodiment of the present invention includes the conductive silicon layer 240 and the oxidized porous silicon layer 250 to control the discharge current. Therefore, the DC-PDP 200 does not necessarily need resistances for controlling the discharge current, thereby reducing manufacturing time and costs.

In the current embodiment of the present invention, since the first electrodes 231 and the second electrodes 232 are formed in the second substrate 212, the first electrodes 231 and the second electrodes 232 can be simultaneously formed, the first conductive silicon layer 241 and the second conductive silicon layer 242 may be formed simultaneously, and the first oxidized porous silicon layer 251 and the second oxidized porous silicon layer 252 may be formed simultaneously, thereby reducing time and cost required to manufacture a DC-PDP.

As described above, according to embodiments of the present invention, since the DC-PDP includes a conductive silicon layer and an oxidized porous silicon layer to control a discharge current, separate resistances for controlling the discharge current are not required, thereby reducing manufacturing time and cost.

Further, according to embodiments of the present invention, since the DC-PDP has a multilayer structure in which the conductive silicon layer and the first oxidized porous silicon layer are sequentially disposed on a substrate through which visible light is transmitted to form an image, an interference effect through the multilayer structure may be used to increase bright room contrast.

Additionally, according to embodiments of the present invention, since electrons emitted from electrodes serving as cathode electrodes are accelerated through an oxidized porous silicon layer, a discharge is easily performed and an operating voltage is reduced, thereby increasing discharge efficiency.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A direct current plasma display panel (DC-PDP), comprising:

a first substrate and a second substrate facing each other;

discharge cells between the first substrate and the second substrate;

first and second electrodes disposed in each of the discharge cells;

first conductive silicon layers contacting the first electrodes;

first oxidized porous silicon layers contacting the first conductive silicon layers;

second conductive silicon layers contacting the second electrodes;

second oxidized porous silicon layers contacting the second conductive silicon layers;

phosphor layers arranged in the discharge cells; and a discharge gas disposed in the discharge cells.

2. The DC-PDP as claimed in claim 1, wherein one of the first electrode and the second electrode is a cathode electrode, and another is an anode electrode.

3. The DC-PDP as claimed in claim 1, wherein the first electrodes extend in a first direction and the second electrodes extend in a second direction crossing the first direction.

4. The DC-PDP as claimed in claim 1, wherein the first conductive silicon layers are doped polysilicon layers, and the first oxidized porous silicon layers are oxidized porous polysilicon layers.

5. The DC-PDP as claimed in claim 1, wherein the first conductive silicon layers are doped amorphous polysilicon layers, and the first oxidized porous silicon layers are oxidized porous amorphous silicon layers.

6. The DC-PDP as claimed in claim 1, wherein the second conductive silicon layers are doped polysilicon layers, and the second oxidized porous silicon layers are oxidized porous polysilicon layers.

7. The DC-PDP as claimed in claim 1, wherein the second conductive silicon layers are doped amorphous polysilicon layers, and the second oxidized porous silicon layers are oxidized porous amorphous silicon layers.

8. The DC-PDP as claimed in claim 1, wherein the first electrodes are arranged on a surface of the first substrate and the second electrodes are arranged on a surface of the second substrate, the second electrodes facing the first electrodes.

9. The DC-PDP as claimed in claim 1, wherein first electrodes and second electrodes are arranged on a surface of the second substrate.

10. The DC-PDP as claimed in claim 1, wherein the first and second conductive silicon layers respectively directly contact only an upper surface of the first and second electrodes.

11. The DC-PDP as claimed in claim 1, wherein the first and second conductive silicon layers respectively directly contact an upper surface of the first and second electrodes and at least one side surface of the first and second electrodes.

12. The DC-PDP as claimed in claim 1, wherein the first and second conductive silicon layers are a same material.

13. A method of manufacturing a direct current plasma display panel (DC-PDP), the method comprising:

forming discharge cells between a first substrate and a second substrate, the first and second substrates facing each other;

forming first and second electrodes in each of the discharge cells;

forming first and second silicon layers to cover the first and second electrodes, respectively;

forming first conductive silicon layers to contact the first electrodes by doping at least part of the first silicon layers;

forming second conductive silicon layers to contact the second electrodes by doping at least part of the second silicon layers;

forming first and second porous silicon layers by changing at least part of the first and second silicon layers, respectively;

changing the first porous silicon layers to first oxidized porous silicon layers, the first oxidized porous silicon layers contacting the first conductive silicon layers;

changing the second porous silicon layers to second oxidized porous silicon layers, the second oxidized porous silicon layers contacting the second conductive silicon layers; and forming phosphor layers in the discharge cells, the discharge cells including a discharge gas.

14. The method as claimed in claim 13, wherein the first and second silicon layers comprise polysilicon.

15. The method as claimed in claim 13, wherein the first and second silicon layers comprise amorphous silicon.

16. The method as claimed in claim 13, wherein the first and second silicon layers are formed using a plasma-enhanced chemical vapor deposition (PECVD) process.

17. The method as claimed in claim 13, wherein the first and second porous silicon layers are formed by anodizing at least part of the first and second silicon layers, respectively, using a solution comprising hydrogen fluoride (HF) and ethanol.

18. The method as claimed in claim 13, wherein the first and second oxidized porous silicon layers are formed by electrochemically oxidizing the first and second porous silicon layers, respectively.

19. The method as claimed in claim 13, wherein the first and second silicon layers are formed directly on the first and second electrodes, respectively.

20. The method as claimed in claim 13, wherein forming the first and second electrodes includes forming the first electrodes on the first substrate and second electrodes on the second substrate.

21. The method as claimed in claim 13, wherein forming the first and second electrodes includes forming the first electrodes and the second electrodes on a surface of a same substrate.

* * * * *